US009714074B2

(12) United States Patent
Luomala et al.

(10) Patent No.: US 9,714,074 B2
(45) Date of Patent: Jul. 25, 2017

(54) ADJUSTABLE CIRCUMFERENTIAL SEAL

(71) Applicant: Whites Manufacturing Ltd., Saanichton (CA)

(72) Inventors: Leo Luomala, Victoria (CA); Ross Davis Harrington, Victoria (CA); Richard Kerr Myerscough, Victoria (CA)

(73) Assignee: Whites Manufacturing Ltd., Saanichton, BC (CA)

( * ) Notice: Subject to any disclaimer, the term of this patent is extended or adjusted under 35 U.S.C. 154(b) by 218 days.

(21) Appl. No.: 14/561,466

(22) Filed: Dec. 5, 2014

(65) Prior Publication Data

US 2016/0031537 A1 Feb. 4, 2016

Related U.S. Application Data

(60) Provisional application No. 62/032,353, filed on Aug. 1, 2014.

(30) Foreign Application Priority Data

Sep. 30, 2014 (CA) ..... 2866277

(51) Int. Cl.
*A43C 1/04* (2006.01)
*B63C 11/04* (2006.01)

(52) U.S. Cl.
CPC ..... *B63C 11/04* (2013.01); *B63C 2011/043* (2013.01)

(58) Field of Classification Search
CPC ..... B63C 11/04; B63C 2011/043; B63C 9/13; Y10T 24/1648; Y10T 24/18; Y10T 24/32; Y10T 24/2179; Y10T 24/2189; Y10T 24/2191; Y10T 24/1696; Y10T 29/4987; A41D 27/18; A41D 3/08; B65D 41/22; B65D 2543/00537
See application file for complete search history.

(56) References Cited

U.S. PATENT DOCUMENTS 6,668,386 B2 12/2003 Vidal
8,037,547 B2 * 10/2011 Duncan ..... A42B 1/048 2/202
2013/0065483 A1 * 3/2013 Liguori ..... A41F 1/006 450/1

* cited by examiner

*Primary Examiner* — Victor Batson
*Assistant Examiner* — Matthew Sullivan
(74) *Attorney, Agent, or Firm* — Davis & Bujold PLLC; Michael J. Bujold

(57) ABSTRACT

An adjustable circumference seal includes an envelope having an outer layer and an inner layer, with the inner layer defining a sealing surface. A circumferential closure is provided for constricting the inner layer of the envelope and thereby adjusting a circumference of the inner layer of the envelope. The closure includes a band having a first end and a second end, with a first cord guide at the first end and a second cord guide at the second end. A cord is threaded from the outer layer through a cord channel in the envelope, through the first cord guide of the band, through the second cord guide of the band and back through the cord channel. By pulling the cord, the circumference of the inner layer of the envelope is reduced until the sealing surface is brought into a sealing engagement. A cord lock for maintains the cord in a selected position.

11 Claims, 5 Drawing Sheets

ADJUSTABLE CIRCUMFERENTIAL SEAL

FIELD

There is described an adjustable circumferential seal that was developed for sealing neck and appendage openings on water immersion suits, but has broader application.

BACKGROUND

U.S. Pat. No. 6,668,386 (Vidal) entitled "adjustable neck seal", discloses one approach to an adjustable circumference seal. There will hereinafter be described an alternative structure for an adjustable circumference seal.

SUMMARY

There is provided an adjustable circumference seal including an envelope having an outer layer and an inner layer, with the inner layer defining a scaling surface. A circumferential closure is provided for constricting the inner layer of the envelope and thereby adjusting a circumference of the inner layer of the envelope. The closure includes a band having a first end and a second end, with a first cord guide at the first end and a second cord guide at the second end. At least one cord channel is provided in the envelope. A cord is threaded from the outer layer of the envelope through the at least one cord channel, through the first cord guide of the band, through the second cord guide of the band and back through the at least one cord channel to the outer layer of the envelope. By pulling the cord, the circumference of the inner layer of the envelope is reduced until the sealing surface is brought into a sealing engagement. At least one fastener serves as a cord lock for maintaining the cord in a selected position.

The configuration of adjustable circumference seal, as described above, functions effectively. There will now be described some additional features that it is preferred be included to further improve functioning.

For ease of manufacture, it is preferred that the inner layer and the outer layer be formed from a sheet of material that is folded, creating a space between the inner layer and the outer layer. The band is positioned in the space between the inner layer and the outer layer. With this configuration, the cord channel consists of an opening through the outer layer of the envelope which communicates with the space between the inner layer and the outer layer. Two cord channels will be illustrated and described, however, it could be made to function with a single cord channel.

The band positioned in the space between the inner layer and the outer layer, may be fixed to the inner layer or the outer layer to maintain the band in a desired position. However, it is preferred that the envelope be made with a narrow portion of a diameter that is relatively narrower than a diameter of a balance of the envelope. Chosen for illustration is a conical configuration. When there is a narrower diameter on the envelope, the cord and the band automatically migrate to the narrow area as they are tightened. The natural migration of the cord and the band make securing the band in position unnecessary.

In water immersion applications (such as diving), water (and sometimes air) tends to accumulate in any spaces. It is, therefore, preferred that the envelope have drainage openings in the outer layer to facilitate drainage from the envelope. It is also preferred that the envelope have inspection openings extending through the outer layer to facilitate inspection of that portion of the cord positioned under the outer layer. Inspection openings are important to ensure that the cord does not deteriorate to the point where it might break during use. It should be noted that, if made a sufficient size, drainage openings can function as inspection openings and inspection openings can function as drainage openings.

If the cord is over-tightened harm may result to the wearer. This is particularly the case if the adjustable circumference seal is positioned around a wearer's neck. It can be difficult for a person wearing gloves or having cold hands to loosen the adjustable circumference seal in an emergency. It is, therefore, preferred that a mechanism be provided to prevent over-tightening. One approach is to mount limiting devices on the cord in the space between the inner layer and the outer layer. The limiting devices are incapable of passing through the cord channel, thereby setting a minimum circumference adjustment. Another approach is to have the first end and the second end of the band serve as limiters. The first end and the second end of the band are incapable of passing through the cord channel, thereby setting a minimum circumference adjustment.

As a practical matter, people come in a variety of neck sizes. It is not always practical to know in advance the neck sizes of all persons in a group of people. It is, therefore, preferred that a length of the band be adjustable. This enables the length of the band to be reduced to accommodate persons with relatively small neck circumferences and expanded to accommodate persons with relatively large neck circumferences.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

An adjustable circumference seal will now be described with reference to FIG. 1 through FIG. 7.

Figure 1:
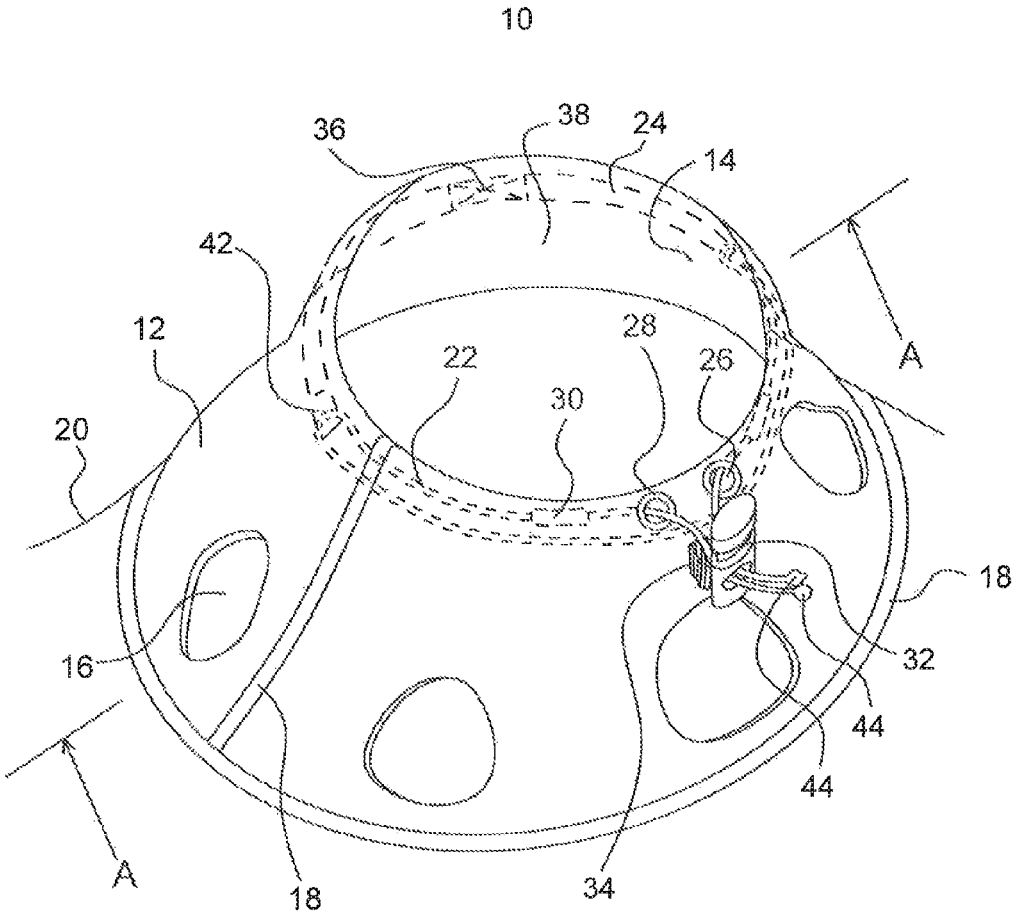
FIG. 1 is a perspective view of an adjustable circumference seal.

Structure and Relationship of Parts:

FIG. 1 shows the invention 10 as it would be applied to the neck opening of a garment 20. The conical seal is in the form of an envelope formed by folding over an inner layer 14 over, at the opening of the conical seal 38, forming an outer layer 12. The material used to make these layers can be neoprene. It can also consist of elastomeric and non-elastomeric water proof materials including single layer films, closed cell foams, open cell foams, woven substrates, multi laminates, breathable membranes material. Between the inner layer 14 and the outer layer 12 a space 40 is formed. The conical shape of the seal is formed through water proof seams 18. These seams 18 can be glued, sewn and taped. They can also be welded or liquid sealed. It is also possible to form this conical shape through molding. Drain openings 16 are put into the outer layer 12 to allow for water drainage of space 40. These drain openings 16 also allow access to the cord 22, the material band 24 and the limiters 30 that are inside the space 40. Checking these parts for wear, adjusting and replacement is possible due to the access through the drain openings 16. The drain openings 16 can be disposed anywhere on the outer layer but preferably they are along the area opposite to the opening of the conical seal 38. The size of the drain openings 16 is not limited, the only constraint is that there needs to be enough area in the outer layer 12 to provide sufficient space 40 to run the cord 22 and the material band 24 through. The material band 24 has cord guides at each end, these cord guides have been illustrated as loops 42. It will be appreciated that cord guides could take a variety of forms, such as holes, grommets, and the like. A cord 22 passes through a cord lock 32, the cord lock 32 being held in place by a webbing 34 that attaches it to the outer layer 12 near the opening of the conical seal, and then the cord passes through the outer layer 12 and into the space 40 via a cord hole 26 that's reinforced by a grommet 28. The cord travels around near the top of the envelope less than 180 degrees where it then passes through a loop 42 in a material band 24. The material band can be secured to the inside of the outer layer 12 by anchor stitching 36. The cord 22 then travels back in the opposite direction near the top of the envelope less than 360 degrees where it passes through a loop 42 at the opposite end of the material band 24. Here the cord 22 reverses direction again and travels around near the top of the envelope less than 180 degrees where it then passes through the outer layer 12 via a cord hole 26, that is reinforced with a grommet 28. The cord 22 passing through the loops 42 defines first and second circumferential cord portions 22A and 22B (see FIG. 4). The cord 22 then passes through the cord lock 32. The cord 22 is made from shock cord, but it can also be made from, but not limited to, elastic or non-elastic materials such as surgical tubing, solid or hollow extruded elastomeric or non-elastomeric polymers, nylon or polyester woven lines. The cord 22 can also be made from webbing, band like material. The material band 24 is made from webbing, and can also be made from, but not limited to, neoprene, molded polymers, films such Mylar, polyurethane and PVC. The material band 24 can also be made from a cord or string like material. The length of the material band 24 could also be adjustable. The cord 22 can also be anchored at the loop in the material band 42. Instead of using a cord lock 32 other fastening devices could be used such as Velcro, magnets, snaps, cleat, knots, ratchets, buckles, ladder locks and winders.

By pulling one or both ends of the cord 44 the circumference of the conical seal opening 38 will be reduced and the cord lock 32 will hold the cord 22 in place. By attaching limiters 30, that are unable the pass through the grommet 28 reinforced cord holes 26 in the outer layer 12, in 2 places along the cord 22, the minimum circumference of the opening of the conical seal 38 can be regulated. The limiters 30 can be made from, but not limited to, polymer tubing, sewn material, molded plastics, plugs, rings, knots, heat shrink tubing, stiffened sections formed within the cord. Their positioning on the cord 22 can be adjustable or fixed. The addition of the limiters 30 to this invention provide means of controlling the circumference of the conical seal to prevent over tightening which could lead to strangulation or loss of blood flow to appendages.

Figure 2:
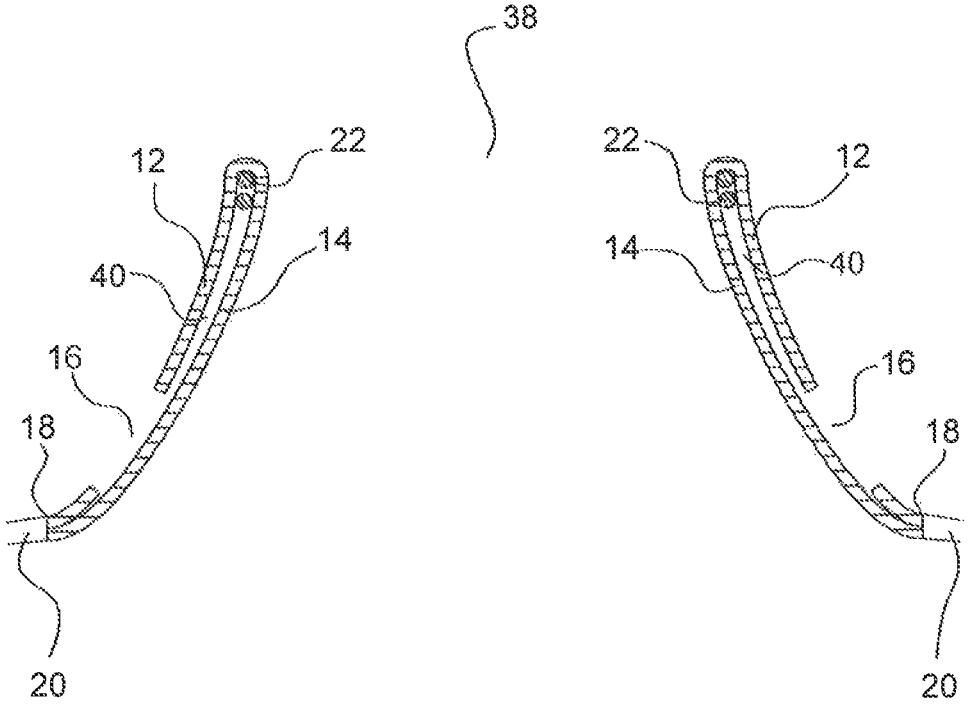
FIG. 2 is a cross sectional front view of section A-A shown in FIG. 1.

FIG. 2 shows the envelope with space 40 formed between the inner 14 and outer layer 12. The drain openings 16 allow water that enters the envelope through the cord holes 26 to drain out. Due to the conical shape of the seal, the cord 22 is treed towards the opening of the conical seal 38 as its circumference is reduced. There are waterproof seams 18 where the seal attaches to the garment 20.

FIGS. 3, 4, 5 and 6 show various configurations of the cord 22, material band 24 and cord lock 32, with inner layer 14 and outer layer 12 removed for clarity.

Figure 3:
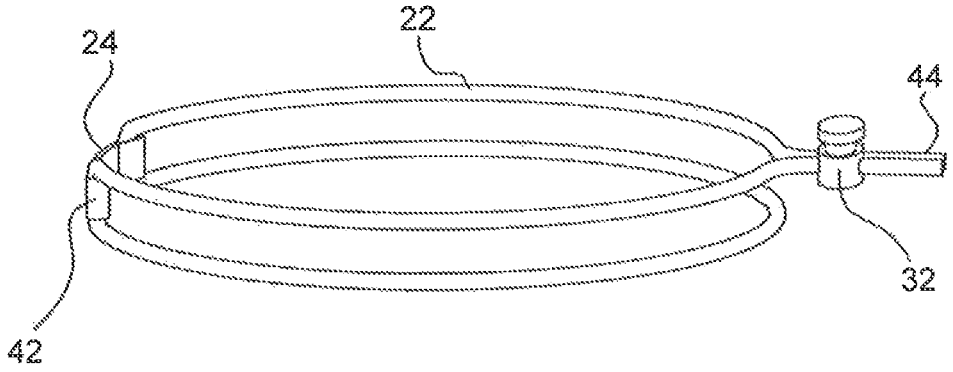
FIG. 3 is a perspective view of the cord, material band and cord lock that are used to adjust the circumference of the opening of the conical seal, with the material band having a length that is substantially less than half the circumference of the opening of the conical seal.

FIG. 3 shows how the material band 24 can be substantially less than half the circumference of the opening of the conical seal 38. In this form the circumference of the opening of the conical seal 38 can be reduced the most as the cord 22 can be reduced in length the greatest by pulling it through the cord lock 32. It is only where the cord 22 passes through the loops 42 in the material band 24 that can't be pulled through the cord holes 26.

Figure 4:
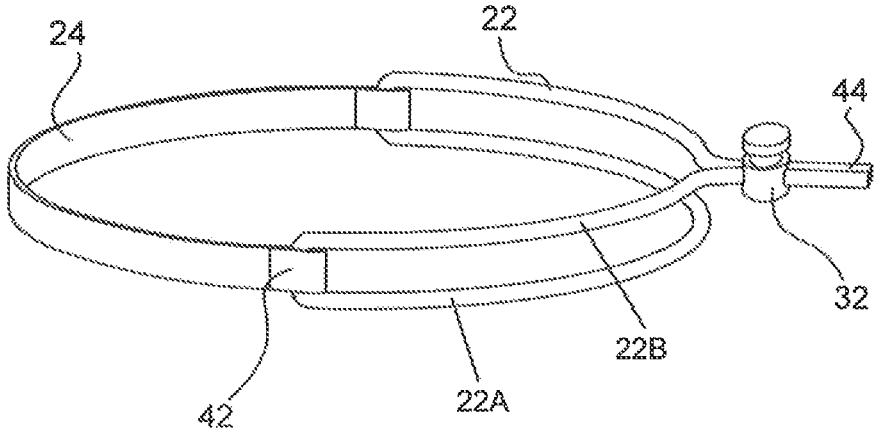
FIG. 4 is a perspective view of the cord, material band and cord lock that are used to adjust the circumference of the opening of the conical seal, with the material band having a length that is approximately half the circumference of the opening of the conical seal.

FIG. 4 shows how the material band 24 can be approximately half the circumference of the opening of the conical seal 38. In this form the circumference of the opening of the conical seal 38 can be reduced by approximately half by pulling it through the cord lock 32, since loops in the material band 24, that the cord 22 passes through, can't be pulled through the cord holes 26.

Figure 5:
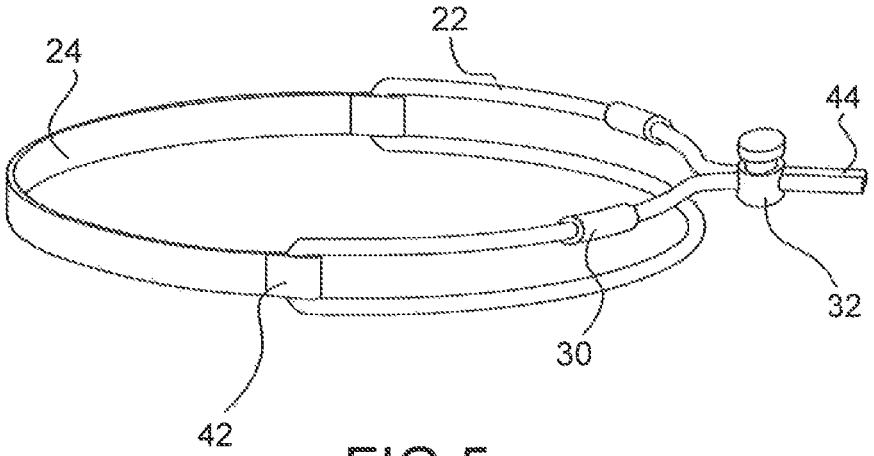
FIG. 5 is a perspective view of the cord, material band and cord lock that are used to adjust the circumference of the opening of the conical seal, with limiters placed on the cord to limit the minimum circumference of the opening of the conical seal.

FIG. 5 shows how limiters 30 can be placed along the cord 22 in 2 positions so that the minimum circumference of the conical seal 38 can be regulated. The limiters 30 are unable to be pulled through the grommet 28 reinforced cord holes 26 as the cord 22 is pulled through the cord lock 32.

Figure 6:
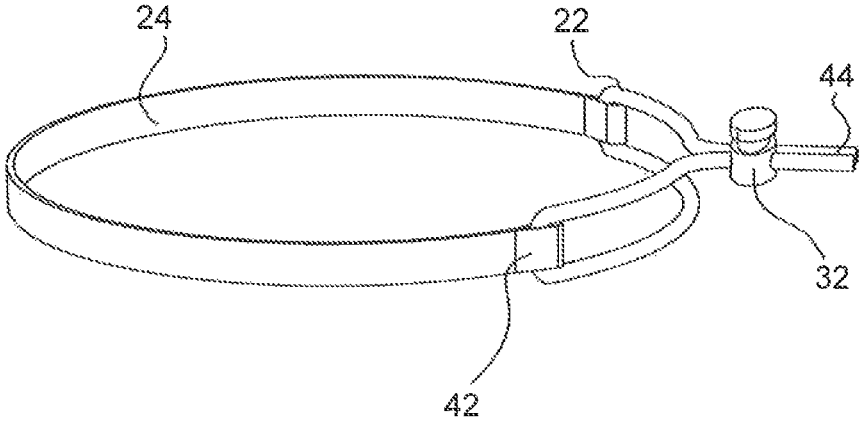
FIG. 6 is a perspective view of the cord, material band and cord lock that are used to adjust the circumference of the opening of the conical seal, with the length of the material band equal to the minimum required circumference of the opening of the conical seal.

FIG. 6 shows how the material band 24 can be made the same length as the minimum required circumference of the opening of the conical seal 38 and as such the loops in the material band act as limiters as they cannot be pulled through the grommet 28 reinforced cord holes 26.

Figure 7:
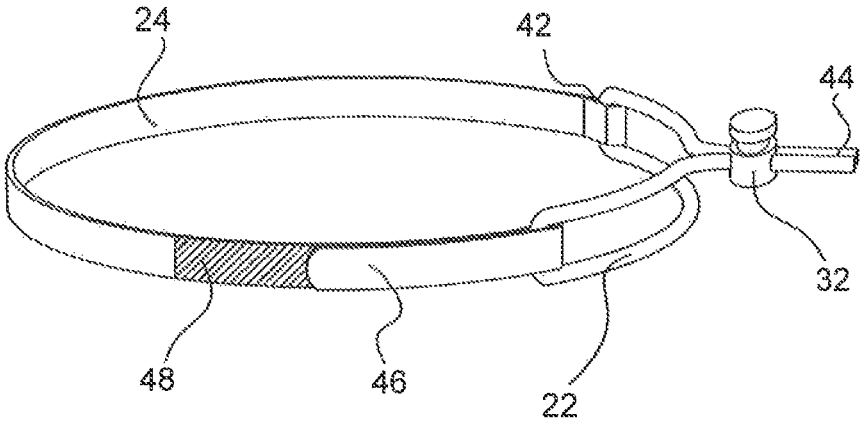
FIG. 7 is a perspective view of the cord, material band and cord lock, with the band being adjustable.

FIG. 7 shows material band 24 being adjustable. In this configuration, material band 24 has a free end 46 and Velcro (hook and loop) fastener 48. Free end 46 of material band 24 goes around the cord 22 and is adjustably attached to the material band 24 using Velcro (hook and loop) fastener. It will be apparent to one skilled in the art, that the adjustment feature could be done in numerous other ways. For example, one could use buckles and belts similar to a baseball cap adjustment.

Advantages:

Adjustable diameter circumference seal 10 is believed to provide a number of advantages over the prior art adjustable diameter circumference seal of Vidal:

1. With Vidal it is possible for an inexperienced user to over-tighten the cord around their neck. This creates a potential choking hazard. The preferred embodiment of adjustable diameter circumference seal 10 has limiters that prevent over-tightening of the cord.

2. With Vidal the positioning of the cord is not controlled. The preferred embodiment of adjustable diameter circumferential seal 10 has a narrowing to which cord migrates.

3. The preferred version of adjustable diameter circumferential seal 10 has a relatively wider portion and a relatively narrower portion. It is easier to get into and out of a garment that has a relatively wider portion.

4. If the cord should break, adjustable diameter circumferential seal 10 will fail. In applications where complete immersion occurs, such as deep water diving, a failure of adjustable diameter circumferential seal 10 may put the wearer at risk. The preferred version of adjustable diameter circumferential seal 10 has drainage openings, as well as provision for inspection of the condition of the cord.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An adjustable circumference seal, comprising:

an envelope having an outer layer and an inner layer, the inner layer defining a sealing surface;

a circumferential closure for constricting the inner layer of the envelope and thereby adjusting a circumference of the inner layer of the envelope, the closure comprising:

a band having a first end and a second end, with a first cord guide at the first end and a second cord guide at the second end;

a cord threaded from the outer layer of the envelope through the first cord guide of the band, through the second cord guide of the band and back through the outer layer of the envelope, the cord having ends portioned outside the outer layer of the envelope, the routing of the cord through the first cord guide and the second cord guide defining a first circumferential cord portion and a second circumferential cord portion, such that, by pulling the cord, excess cord slides through the first cord guide and the second cord guide becoming part of the second circumferential cord portion as a circumferential dimension of the first circumferential cord portion and the circumference of the inner layer of the envelope is reduced until the sealing surface is brought into a sealing engagement; and at least one fastener for reducing a circumferential dimension of the second circumferential cord portion and maintaining the cord in a selected position.

2. The adjustable circumference seal of claim 1, wherein the inner layer and the outer layer are formed from a sheet of material that is folded, creating a space between the inner layer and the outer layer, the band being positioned in the space between the inner layer and the outer layer.

3. The adjustable circumference seal of claim 2, wherein at least one cord channel is provided in the envelope, the at least one cord channel is comprised of an opening through the outer layer of the envelope which communicates with the space between the inner layer and the outer layer.

4. The adjustable circumference seal of claim 1, wherein the envelope has a narrow portion of a diameter that is relatively narrower than a diameter of a balance of the envelope.

5. The adjustable circumference seal of claim 1, wherein the first cord guide is a loop and the second cord guide is a loop.

6. The adjustable circumference seal of claim 2, wherein the envelope has drainage openings in the outer layer to facilitate drainage from the envelope.

7. The adjustable circumference seal of claim 2, wherein the envelope has inspection openings extending through the outer layer to facilitate inspection of that portion of the cord positioned under the outer layer.

8. The adjustable circumference seal of claim 3, wherein limiting devices that are mounted on the cord in the space between the inner layer and the outer layer, the limiting devices being incapable of passing through the at least one cord channel, thereby setting a minimum circumference adjustment.

9. The adjustable circumference seal of claim 1, wherein a length of the band is adjustable.

10. The adjustable circumference seal of claim 3, wherein the first end and the second end of the band serve as limiters, the first end and the second end of the band being incapable of passing through the at least one cord channel, thereby setting a minimum circumference adjustment.

11. The adjustable circumference seal of claim 1, wherein the band is fixed to the envelope.

* * * * *